US008110009B2

(12) United States Patent
Higa et al.

(10) Patent No.: US 8,110,009 B2
(45) Date of Patent: Feb. 7, 2012

(54) PETROLEUM BASED PROCESSED DETERGENT FOR DRY CLEANING AND ITS USE

(75) Inventors: Teruo Higa, Okinawa (JP); Hirosi Kita, Kagawa (JP); Masahiro Mizukami, Osaka (JP)

(73) Assignee: Robert N. Lee, Little Ferry, NJ (US)

( * ) Notice: Subject to any disclaimer, the term of this patent is extended or adjusted under 35 U.S.C. 154(b) by 470 days.

(21) Appl. No.: 11/864,104

(22) Filed: Sep. 28, 2007

(65) Prior Publication Data

US 2008/0241908 A1 Oct. 2, 2008

Related U.S. Application Data

(60) Provisional application No. 60/847,707, filed on Sep. 28, 2006.

(51) Int. Cl.
*D06L 1/04* (2006.01)
*D06M 16/00* (2006.01)

(52) U.S. Cl. ..... 8/142; 435/264; 510/481

(58) Field of Classification Search ..... 435/264; 8/142; 510/481
See application file for complete search history.

(56) References Cited

U.S. PATENT DOCUMENTS 4,267,077 A * 5/1981 Niimi et al. ..... 510/287
4,561,991 A * 12/1985 Herbots et al. ..... 510/281

FOREIGN PATENT DOCUMENTS

JP 2001152188 A * 6/2001

OTHER PUBLICATIONS

Derwent Acc. No. 2001-505721, English abstract for JP 2001-152188 A.*

* cited by examiner

*Primary Examiner* — Harold Pyon
*Assistant Examiner* — Katie L Hammer

(57) ABSTRACT

The present invention provides compositions and methods for dry cleaning garments. The present invention provides a petroleum based processed detergent for dry cleaning and methods of use. The present invention provides methods of using the petroleum based processed detergent for dry cleaning wherein use of the detergent decreases the proliferation of bacteria and microbes in the detergent, and reduces the opposite pollution ratio of the detergent following a dry cleaning cycle. Additionally, the petroleum based processed detergent maintains a stable conductivity during use.

12 Claims, 2 Drawing Sheets

PETROLEUM BASED PROCESSED DETERGENT FOR DRY CLEANING AND ITS USE

CROSS REFERENCE TO RELATED APPLICATIONS

This application claims priority from U.S. provisional patent application Ser. No. 60/847,707, filed on Sep. 28, 2006, which is incorporated by reference in its entirety herein.

FIELD OF THE INVENTION

The present invention provides compositions and methods for dry cleaning garments. The present invention provides a petroleum based processed detergent for dry cleaning and methods of use. The present invention provides methods of using the petroleum based processed detergent for dry cleaning wherein use of the detergent decreases the proliferation of bacteria and microbes in the detergent, and reduces the opposite pollution ratio of the detergent following a dry cleaning cycle. Additionally, the petroleum based processed detergent maintains a stable conductivity during use.

BACKGROUND

Various types of detergent were reported for use with petroleum based solvents in the past. (e.g. see Tokkaihei, Japanese Patent Application No. 11-323381). However, the petroleum based detergent used for dry cleaning that was disclosed in 11-323381 had little effect on the multiplication of bacteria in the dry cleaning solution, which in turn caused stench and accumulation of sludge in the solution. Subsequently, when the mixture of the petroleum based solvent and the detergent (i.e. the dry cleaning solution), which is stored in the base tank of the dry cleaning machine, was repeatedly used, the problematic bacteria multiplied easily with time. In addition, the detergency for the laundry became ineffective, and there were other problems such as color loss, molds, and stench observed in the laundry. With multiple use, other problems were found: decrease in the operational stability of the static electricity sensors in the dry cleaning machine due to lowered conductivity of the solvent, reverse pollution where dirt is adsorbed back onto the fiber, and rise in the aniline point which is a measure of how much oil and fats are dissolved in the solvent.

Effective Microorganism technology has bee developed and used in a wide range of applications such as river purification, soil quality improvement and stench prevention in animal husbandry.

SUMMARY OF THE INVENTION

The present invention provides for a petroleum based processed detergent and methods of using the petroleum based processed detergent as part of a dry cleaning solution for dry cleaning materials, such as garments. The methods of the invention can reduce the rise of the aniline point that is normally associated with a dry cleaning solution following a dry cleaning cycle. The present invention also reduces the pollution ratio of the dry cleaning solution following a dry cleaning cycle, and at the same time, improves the conductivity of the dry cleaning solution.

In one embodiment of the invention, the petroleum based processed detergent includes a dry soap, an Effective Microorganisms (EM) which controls multiplication of harmful bacteria and microbes in the dry cleaning solution, and water, wherein the dry soap is acidified.

The invention also provides a dry cleaning solution containing a petroleum based solvent and the petroleum based processed detergent.

In another embodiment of the invention, the petroleum based processed detergent is used to dry clean materials, such as, for example, garments, as part of a dry cleaning solution, wherein the dry cleaning solution includes the petroleum based processed detergent and a petroleum based solvent.

DETAILED DESCRIPTION

Figure 1:
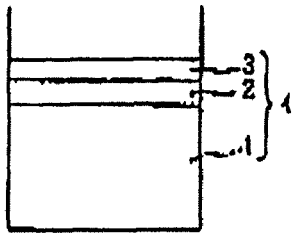
FIG. 1 shows the structure of the petroleum based processed detergent relating to this invention. The petroleum based processed detergent (4) includes a dry soap (1), and Effective Microorganism (EM) (2) and water (3).

The present invention provides for a dry cleaning solution, wherein the solution includes a petroleum based processed detergent. The present invention also provides for methods of using the petroleum based processed detergent for dry cleaning materials, such as garments. The compositions and methods of the invention can reduce the rise of the aniline point that is normally associated with dry a cleaning solution following a dry cleaning cycle, and can also reduce the opposite pollution ratio of the dry cleaning solution following a dry cleaning cycle. The compositions and methods of the invention can also improve and stabilize the conductivity of the dry cleaning solution. The present invention provides additional advantages over existing dry cleaning solutions and detergents, for example, a reduction in proliferation of bacteria, fungus and microbes in a dry cleaning solution, and a reduction in stench and accumulation of sludge in a dry cleaning solution following one or more dry cleaning cycles.

In one non-limiting embodiment of the invention, the petroleum based processed detergent includes 3-8 parts by weight of an Effective Microorganisms (EM).

In a further non-limiting embodiment, the EM can be, for example, but not limited to, lactobacillus, yeast, phototrophic bacteria, or mixtures thereof.

In another embodiment, the Effective Microorganisms inhibit multiplication of harmful bacteria and microbes in the petroleum based processed detergent and/or the dry cleaning solution, wherein the EM has an anti-oxidation and non-ionization effect on the dry cleaning solution.

In another non-limiting embodiment of the invention, the petroleum based processed detergent includes 3-8 parts by weight water.

In one embodiment, the water is distilled water. Alternatively, the water includes fine molecules.

In another non-limiting embodiment of the invention, the petroleum based processed detergent for dry cleaning includes 100 parts by weight of a dry soap, wherein the dry soap is acidified to pH 3-4, preferably below pH 4.0, further preferably below pH 3.5, even further preferably pH 3.0-3.5.

Thus, according to the invention, the petroleum based processed detergent of the invention, is achieved by combining 3-8 parts by weight of Effective Microorganisms (EM) which controls multiplication of harmful microbes with an anti-oxidation and non-ionization effect, and 3-8 parts by weight of distilled water or water with fine molecules, adding to 100 parts by weight of the dry soap where it is acidified to pH 3-4, preferably below pH 4.0, further preferably below pH 3.5, even further preferably pH 3.0-3.5.

The method of dry cleaning using a dry cleaning solution comprising a petroleum based processed detergent which relates to the present invention, allows for reducing or decreasing the rise of the aniline point of the dry cleaning solution after one or more dry cleaning cycles. Such an effect is an advantage over known dry cleaning detergents which experience an increase in the aniline point following one or more dry cleaning cycles. In addition, according to the invention, the opposite or reverse pollution ratio of the detergent following one or more dry cleaning cycles can be decreased. According to the invention, the opposite or reverse pollution ratio of the dry cleaning solution is a comparison of the dirt, soil, fungus and/or bacteria present in the dry cleaning solution before one or more dry cleaning cycles and the dry cleaning solution following one or more dry cleaning cycles. Such pollutants are not desirable since they can be adsorbed onto the fibers of a garment being dry cleaned.

Furthermore, the compositions and methods of the invention can improve the detergent's conductivity, for example, by increasing the stability of the dry cleaning solution's conductivity, and thus, reduce operational stability decreases in the static electricity sensor which shows the density of the detergent in the dry cleaning solution.

According to the invention, a dry cleaning solution is used to dry clean materials, such as garments, wherein the dry cleaning solution includes the petroleum based processed detergent and a petroleum based solvent.

In one embodiment of the invention, the petroleum based solvent includes an aromatic type, a naphthene type and/or a paraffin type of solvent.

In one embodiment of the invention, the petroleum based processed detergent is at a concentration of 0.2-1.0% of the dry cleaning solution.

In an alternative embodiment, the dry cleaning solution includes both petroleum based solvent and 0.2-1.0% petroleum based processed detergent to petroleum based solvent.

In another embodiment of the invention, the dry cleaning cycle may be performed one or multiple times without filtering the petroleum based processed detergent, the petroleum based solvent, or the dry cleaning solution.

In another embodiment, following one or more dry cleaning cycles, and prior to initiation of a second or successive dry cleaning cycle, 3-5 cc of petroleum based processed detergent is added to the dry cleaning solution for every 1 kg of dry garment introduced into the machine for a second or successive dry cleaning cycle.

In another embodiment of the invention, a material, such as a garment, can be dry cleaned one or more times with a dry cleaning solution prepared and used according to the present invention without a loss in the texture of the garment.

As shown in FIG. 1, the petroleum based processed detergent which relates to this invention utilizes the Effective Microorganisms (EM) (2). In one, non-limiting embodiment, the Effective Microorganisms, EM (2), is a collection of beneficial microbes such as, for example, but not limited to, lactobacillus, yeast and phototrophic bacteria, which are harmless to the human body. This EM (2) functions to control the proliferation of harmful fungus, bacteria and/or microbes in the dry cleaning detergent and solution. The petroleum based processed detergent which relates to this invention, consists of dry soap (1) for the dry cleaning, to which the Effective Microorganisms, EM (2), and the distilled water (or water with fine molecules) (3) are added. Preferably, the petroleum based processed detergent includes 100 parts by weight of the dry soap which is adjusted pH 3.5 (1), 3-8 parts by weight of Effective Microorganisms, EM (2), and 3-8 parts by weight the distilled water or water with fine molecules (3).

A dry soap (1) with a pH below pH 3.5 provides an environment in which the Effective Microorganisms (2) are highly activated. When pH is reduced too much, however, the activity of the microorganisms, such as phototrophic bacteria among other beneficial microorganism (2), is reduced. In one non-limiting embodiment of the invention, the pH of the dry soap is pH 3.0-3.5.

In another non-limiting embodiment, the dry soap is adjusted to a pH in which the Effective Microorganisms (EM) are active.

Figure 2:
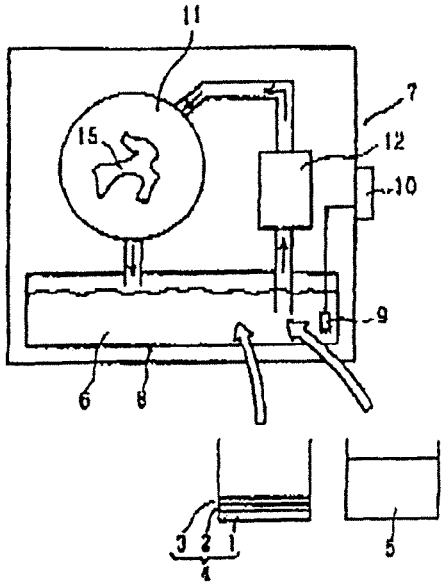
FIG. 2 shows a dry cleaning machine in which a garment is dry cleaned using the petroleum based processed detergent. A petroleum based solvent (5) and the petroleum based processed detergent (4) are placed in a base tank (8) in the dry cleaning machine (7), creating a dry cleaning solution (6) which is stored in the base tank (8) for use during dry cleaning. A soap control indicator (10) attached on the outside of the dry cleaning machine (7) measures the amount of petroleum based processed detergent (4) in the dry cleaning solution (6). A static sensor (9) installed on the base tank (8) transmits a signal to the soap control indicator (10), indicating the quantity of petroleum based processed detergent.

In one embodiment of the invention, a method of dry cleaning a garment includes the following steps:

First, as shown in FIG. 2, both the petroleum based solvent (5) and 0.2-1.0% of the processed detergent (4) to petroleum based solvent are placed into a base tank (8) in a dry cleaning machine (7), wherein the petroleum based solvent and the petroleum based processed detergent comprise a dry cleaning solution (6) inside the base tank (80), where the solution is stored.

The quantity of the processed detergent (4) in solution (6), is measurable and readable on the soap control indicator (10), attached outside of the dry cleaning machine (7), which receives a signal from the static sensor (9), installed inside the based tank (8) assessing the detergent quantity.

Second, after a garment (15) is loaded into the washing drum (11), the dry cleaning machine (7) is activated, at which point the solution (6) in the base tank (8) consisting of the petroleum based solvent (5) and the petroleum based processed detergent (4), is filled, through a filter (12), and into the washing drum (11) where the garment (15) is washed. Alternatively, the garment can be added to the dry cleaning machine before the dry cleaning solution, or simultaneously with the dry cleaning solution.

According to the methods of the present invention, when garments in the washing drum are replaced, for example, at the completion of a first dry cleaning cycle and prior to the initiation of a second dry cleaning cycle, an additional application of the petroleum based processed detergent (4) is supplied into the solution (6), wherein the petroleum based processed detergent is in the ratio of 3-5 cc to 1 kg dry garments. Furthermore, the filter (12) functions to remove dirt and stench from the dry cleaning solution (the petroleum based processed detergent and/or the petroleum based solvent).

Finally, the solution (6) passes through the washing drum (11), and back into the base tank (8).

In one embodiment of the invention, the laundry time is performed as a batch washing of between 2 and 20 minutes, and a filter circulation of the dry cleaning solution of between 4 and 10 minutes.

In accordance with the compositions and methods of the invention, the EM of the petroleum based process detergent exerts synergistic anti-oxidization, non-ionization, effects on the dry cleaning solution, and a decrease in harmful fungus and/or bacteria in the dry cleaning solution, resulting in a decrease in the reverse pollution ratio of the dry cleaning solution following one or more dry cleaning cycles.

EXAMPLES

Example 1

The data of in-range and out-of-range experiments by the dry cleaning methods according to the present invention are shown below.

Table 1-Table 3 demonstrate the comparison between the processed detergent (4) (the invention) and an existing detergent on the market (An existing product). Reverse pollution is influenced by the ratio of the detergent density to the petroleum based solvent (5).

Table 1 (in-range data 1) shows the result from the condition in which the density of the processed detergent (4) to the petroleum based solvent (5) is within the range of the recommended use of the processed detergent relating to this invention (0.2-1.0%). Table 2 (out-of-range data 1) indicates the outcome under the situation in which the density of the processed detergent (4) to the petroleum based solvent (5) is lower than the range of recommended use of the processed detergent relating to this invention (0.2-1.0%). Table 3 (out-of-range data 2) exhibits the consequence when the density of the processed detergent (4) to the petroleum based solvent (5) is higher than the range of recommended use of the processed detergent relating to this invention (0.2-1.0%).

The composition used in the experiment is defined as the composition of 5 parts by weight of the Effective Microorganisms (EM), and 5 parts by weight of the distilled water, added to 100 parts by weight of the dry soap. The duration time of each laundry cycle conducted for table 1-table 3 is: batch washing 4 minutes, filter circulating 5 minutes, extraction 4 minutes

TABLE 1

IN-RANGE DATA 1
(1.0% OF THE PROCESSED DETERGENT TO SOLVENT)

| | RATIO OF REVERSE POLLUTION | |
|---|---|---|
| MATERIAL | The Invention | An Existing Product |
| Polyester | 0.8% | 1.4% |
| Polyester/Cotton | 0.4% | 1.9% |
| Cotton | 1.3% | 2.4% |
| Wool | 0.9% | 1.8% |
| Acryl | 1.0% | 2.4% |

TABLE 2

OUT-OF-RANGE DATA 1
(0.1% OF THE PROCESSED DETERGENT TO SOLVENT)

| | RATIO OF REVERSE POLLUTION | |
|---|---|---|
| MATERIAL | The Invention | An Existing Product |
| Polyester | 2.3% | 2.1% |
| Polyester/Cotton | 2.6% | 2.6% |
| Cotton | 4.2% | 4.3% |
| Wool | 1.8% | 1.8% |
| Acryl | 2.2% | 2.5% |

TABLE 3

OUT-OF-RANGE DATA 2
(1.5% OF THE PROCESSED DETERGENT TO SOLVENT)

| | RATIO OF REVERSE POLLUTION | |
|---|---|---|
| MATERIAL | The Invention | An Existing Product |
| Polyester | 1.2% | 1.6% |
| Polyester/Cotton | 0.6% | 1.8% |
| Cotton | 1.4% | 3.2% |
| Wool | 0.9% | 1.9% |
| Acryl | 1.6% | 2.6% |

Table 1 (in-range data 1) above shows that the reverse pollution ratio of the petroleum based processed detergent (4) relating this invention, clearly decreases in comparison to that of the existing product.

In addition, table 2 (out-of-range data 1) indicates that when the density of the petroleum based processed detergent is below 0.2%, little difference can be observed between the invention product (4) and the existing product.

Furthermore, table 3 (out-of-range data 2) displays that the reverse pollution ratio by the petroleum based processed detergent (4) of this invention, clearly decreases in comparison to that of the existing product. However, when the density of the processed detergent exceeds 1.0%, it is observed that the texture of garments (15) is lost.

Examining the results from the above-mentioned in-range data 1 (Table 1), out-of-range data 1 (Table 2), and out-of-range data 2 (Table 3), it is observed that the reverse pollution ratio can be lowered without losing the texture of garments (15). This is possible when the density of the processed detergent to the petroleum solvent (5), is within the range of the dry cleaning methods of the invention (0.2-1.0%).

Table 4 below (in-range data 2) exhibits the results of the aniline point test of the solution (6). According to the methods of the present invention, a garment (15) was washed by dry cleaning. The aniline points of the solution (6) on pre-washing state is tested by comparison with that of post-500-time-wash. The processed detergent used in this experiment is the same as the detergent used above and defined by Tables 1-3.

TABLE 4

IN-RANGE DATA 2

| | ANILINE POINT TEMPRETURE DIFFERENCE BET. PRE- | ANILINE POINTS | | |
|---|---|---|---|---|
| SOLVENTS | WASH & POST-WASH | PRE-WASH | POST-500-TIME-WASH | STANDAND VALUE |
| Aromatic type (Begazole 3040) | 1.0° C. | 53.8° C. | 54.8° C. | 56° C. |
| Naphthene type (New Sol DX High Soft) | 1.3° C. | 65.2° C. | 66.5° C. | 67° C. |
| Paraffin type (Nikko White N-10) | 0.8° C. | 77.2° C. | 78.0° C. | 78° C. |

Table 4 above (in-range data 2) demonstrates that there is little difference observed in terms of the aniline points of the solution (6) on the post-500-time-application by comparison with the pre-washing state. In addition, comparing the aniline points of solution (6) on post-500-time-application to that of standard value does not display any differences.

Table 5 below shows the result of measuring the conductivity of the solution (6). This test is executed to see how conductivity is influenced by the processed detergent of this invention (4), by comparison with an existing detergent (an existing product). Five different densities of the processed detergent to the petroleum based solvent (5) were used: 0.1%, 0.2%, 0.5%, 1.0% and 1.5%. The conductivity is determined by the stable time on the soap control indicator (10).

TABLE 5

| | OUT-OF-RANGE DATA 3 DENSITY OF DETERGENT 0.1% | IN-RANGE DATA 3 DENSITY OF DETERGENT 0.2% | IN-RANGE DATA 4 DENSITY OF DETERGENT 0.5% | IN-RANGE DATA 5 DENSITY OF DETERGENT 1.0% | OUT-OF-RANGE DATA 4 DENSITY OF DETERGENT 1.5% |
|---|---|---|---|---|---|
| THE INVENTION | Unreadable | 30 min. | 65 min. | 230 min. | 300 min. |
| AN EXISTING PRODUCT | Unreadable | Unreadable | 30 min. | 150 min. | 220 min. |

Table 5 above indicates that in the case of the out-of-range data 3, in which the density is 0.1%, neither the processed detergent according to the invention, nor the existing product exhibited stabilization of the soap control indicator (10). On the other hand, in the case of the out-of-range data 4, in which the density is 1.5%, stability of the petroleum based processed detergent (4) of this invention improves as compared to the existing product. However, in this case, the texture of the garment (15) is lost.

In case of the in-range data 3 (density 0.2%), the in-range data 4 (density 0.5%), and the in-range data 5 (density 1.0%), the stability of the processed detergent (4) of this invention is improved more clearly than that of the existing product. No problems are observed in terms of the texture of garment (15). Considering all the results from the out-of-range data 3, out-of-range data 4, in-range data 3, in-range data 4, and in-range data 5 in table 5 above, it is observed that the conductivity can be satisfactorily stabilized on the soap control indicator (10) without damaging the texture of garment (15). This is possible when the density of the processed detergent to the petroleum solvent (5), is kept within the range of the dry cleaning method of this invention (0.2-1.0%).

The dry cleaning method using the petroleum based processed detergent relating to this invention can prevent weakening of detergency because Effective Microorganisms, EM (2), can control the multiplication of harmful bacteria in the solution (6) even after many laundry washing cycles. Because of this, by comparison with existing products, a loosening, or relaxation, of the rise in aniline points, which is an indication of fat-solubleness, is induced, even after repeated laundry processes.

Concretely, with the use of an aromatic type, naphthene type and paraffin type of solvent, the method can decrease the aniline point in comparison to an existing product by 1.0-2.0 centigrade degree following post-500-time-wash.

In addition, by comparison with an existing petroleum based detergent, the detergent of the present invention can control reverse pollution, such that damage to the color of the garment (15) from soil in the solution (6) adsorbed back onto the fabric is reduced.

By applying 0.2-1.0% of the processed detergent (4) to a petroleum based solvent (5), and further, by adding 3-5 cc of the processed detergent (4) to the dry cleaning solution for every 1 kg of dry clothing added to the washing drum for a subsequent wash, anti-oxidation and non-ionization of the dry cleaning solution can be induced and maintained, resulting in a decrease in the reverse pollution ratio of the dry cleaning solution.

The petroleum based processed detergent can therefore improve the conductivity of the solution (6) by use of the processed detergent constituting of 100 parts by weight of the dry soap which is adjusted pH 3.5 (1), 3-8 parts by weight of Effective Microorganisms, EM (2), and 3-8 parts by weight the distilled water or water with fine molecule (3). Thus, when the density of the processed detergent (4) to the petroleum based solvent (5) is set to be lower than that of existing products in market, it is possible to reduce the use of antistatics in to prevent static explosions. This is made possible because of the non-ionization effect which EM provides.

Additionally, because the invention improves conductivity, the imbalance of operational stability of static sensor (9) connected to the soap control indicator (10) which shows the density of the processed detergent (4) for the petroleum based solvent (5), is corrected. Such correction is possible when the density of the processed detergent (4) to the petroleum based solvent 5 is set between 0.2-1.0%.

It is possible to create an ideal condition for the activation of Effective Microorganisms (2) by adjusting the pH level of the dry soap (1) to below pH 3.5. Thus, activating the Effective Microorganisms (2) to achieve maximal detergency.

In addition, comparison of the use of tap water and distilled water in the detergent, it is noted that distilled water (3) (or water with fine molecules) can control or decrease the quantity of impurities in the water, which are detrimental maximal Effective Microorganisms (2) functionality. Thus, it is possible to raise the effectiveness of the detergent by preventing such a decrease in EM activity.

All percentages or weights described herein presumed to include the term about before the numbers used therefore. Various publications are cited herein, the contents of which are hereby incorporated by reference in their entireties.

What is claimed is:

1. A dry cleaning solution which comprises a petroleum based solvent and a petroleum based processed detergent, wherein the petroleum based processed detergent further comprises a dry soap, an effective microorganism and water, wherein the effective microorganism is selected from the group consisting of lactobacillus, yeast, phototrophic bacteria, or a mixture thereof and the dry soap is acidified.

2. The dry cleaning solution of claim 1, wherein the concentration of the petroleum based processed detergent is 0.2-1.0%.

3. The dry cleaning solution of claim 1, wherein the petroleum based solvent is selected from the group consisting of an aromatic, a naphthene and a paraffin of solvent.

4. The dry cleaning solution of claim 1, wherein the effective microorganism inhibits oxidation and ionization of the dry cleaning solution.

5. The dry cleaning solution of claim 1, wherein the pH of the dry soap is between 3.0-3.5.

6. The dry cleaning solution of claim 1, wherein the effective microorganism is lactobacillus.

7. The dry cleaning solution of claim 1, wherein the effective microorganism is yeast.

8. The dry cleaning solution of claim 1, wherein the effective microorganism is phototrophic bacteria.

9. The detergent of claim 1, wherein the pH of the dry soap is below 4.0.

10. The detergent of claim 1, wherein the pH of the dry soap is below 3.5.

11. The detergent of claim 1, wherein the detergent comprises 3-8 parts by weight of the effective microorganism.

12. The detergent of claim 1, wherein the detergent comprises 3-8 parts by weight of water.

* * * * *